United States Patent [19]

Havas

[11] 4,139,723

[45] Feb. 13, 1979

[54] POWER CONTROL UNIT FOR A SINGLE PHASE LOAD WITH SLIGHTLY CHANGING IMPEDANCES

[75] Inventor: George Havas, Youngstown, Ohio

[73] Assignee: Ajax Magnethermic Corporation, Warren, Ohio

[21] Appl. No.: 789,499

[22] Filed: Apr. 21, 1977

[51] Int. Cl.[2] ..... H05B 1/02; H05B 5/04

[52] U.S. Cl. ..... 13/26; 323/25; 323/105; 323/106; 323/119

[58] Field of Search ..... 323/23, 24, 25, 101, 323/105, 119, 122, 128, 106; 13/26

[56] References Cited

U.S. PATENT DOCUMENTS

| | | | |
|---|---|---|---|
| 3,436,609 | 4/1969 | Francis | 323/24 |
| 3,530,370 | 9/1970 | Yamachi et al. | 323/128 |
| 3,676,766 | 7/1972 | Blackmond | 323/24 |
| 3,731,183 | 5/1973 | Johnson et al. | 323/24 |
| 3,821,456 | 6/1974 | Havas | 13/26 |
| 4,037,044 | 7/1977 | Havas | 13/26 |

*Primary Examiner*—Gerald Goldberg
*Attorney, Agent, or Firm*—J. H. Slough

[57] ABSTRACT

There is disclosed herein a power control unti for controlling the voltage and power delivered to a single phase load, said control unit being preferably employed with loads whose impedance changes but slightly over the work cycle. The circuit utilizes a diode rectifier and a controlled rectifier connected in parallel therewith connected in series with capacitance and achieves transient-free and harmonic-free power control.

4 Claims, 5 Drawing Figures

POWER CONTROL UNIT FOR A SINGLE PHASE LOAD WITH SLIGHTLY CHANGING IMPEDANCES

This invention relates to power control means for a single phase load for operation from a normal line frequency power supply and particularly relates to transient and harmonic-free control of said single phase load in a simple, reliable manner. Said single phase load may be of the resistive or resistive-inductive type. Preferably the control means of the invention is employed with loads whose impedance changes but slightly over the work cycle.

Certain prior art with which I am familiar, namely, U.S. Pat. No. 3,731,183 to Johnson and Herrman dated May 1, 1973, discloses the use of pairs of anti-parallel thyristors, one of which thyristors is triggered during each half cycle; said patent teaches the triggering of said thyristor at a retard angle and the apparatus is said to be useful in compensating for relatively large varying inductive loads.

A co-pending application of the present inventor, Ser. No. 601,644, filed Aug. 4, 1975 now U.S. Pat. No. 4,037,044, discloses the use of controlled rectifier means and diode rectifier means in parallel, said diode rectifier means conducting current only in one direction and the controlled rectifier means only in an opposite direction, interposed in series with capacitors to effect control of the phase angle between furnace voltage and series capacitor voltage and to effect control of the voltage and power delivered to said load. Said invention was particularly applicable for use with induction furnace loads whose impedance changed greatly throughout the work cycle.

The present invention particularly relates as hereinbefore noted to loads wherein the impedance changes but slightly, and while it involves the use of one principle of the invention of the co-pending application, due to its preferred application, it eliminates the use of the entire group of sets of series connected capacitance and semiconductor means used to effect control of the phase angle between furnace voltage and series connected capacitor voltage.

It is an object of this invention to provide improvements in system durability, simplicity and reliability as well as economy.

It is a further object of this invention to achieve power control in a virtually stepless manner.

Another object of this invention is to achieve power control in a harmonic-free manner without the use of additional filtering.

A still further object of this invention is to achieve power control in a transient-free manner.

Other objects of my invention and the invention itself will become more readily apparent from the purview of the drawings and description in which drawings.

Figure 3:
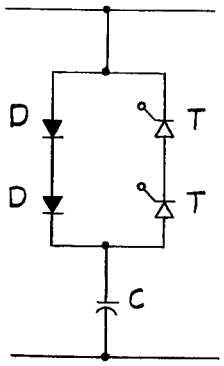
Figure 4:
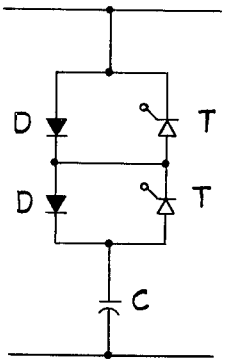
Figure 5:
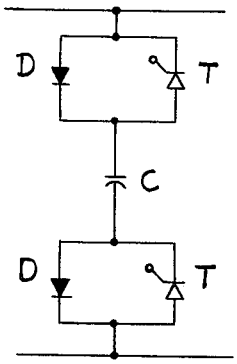

FIGS. 3, 4, and 5 illustrate a few of the various alternate ways in which the diode rectifier means and controlled rectifier means may be connected within a set.

Figure 1:
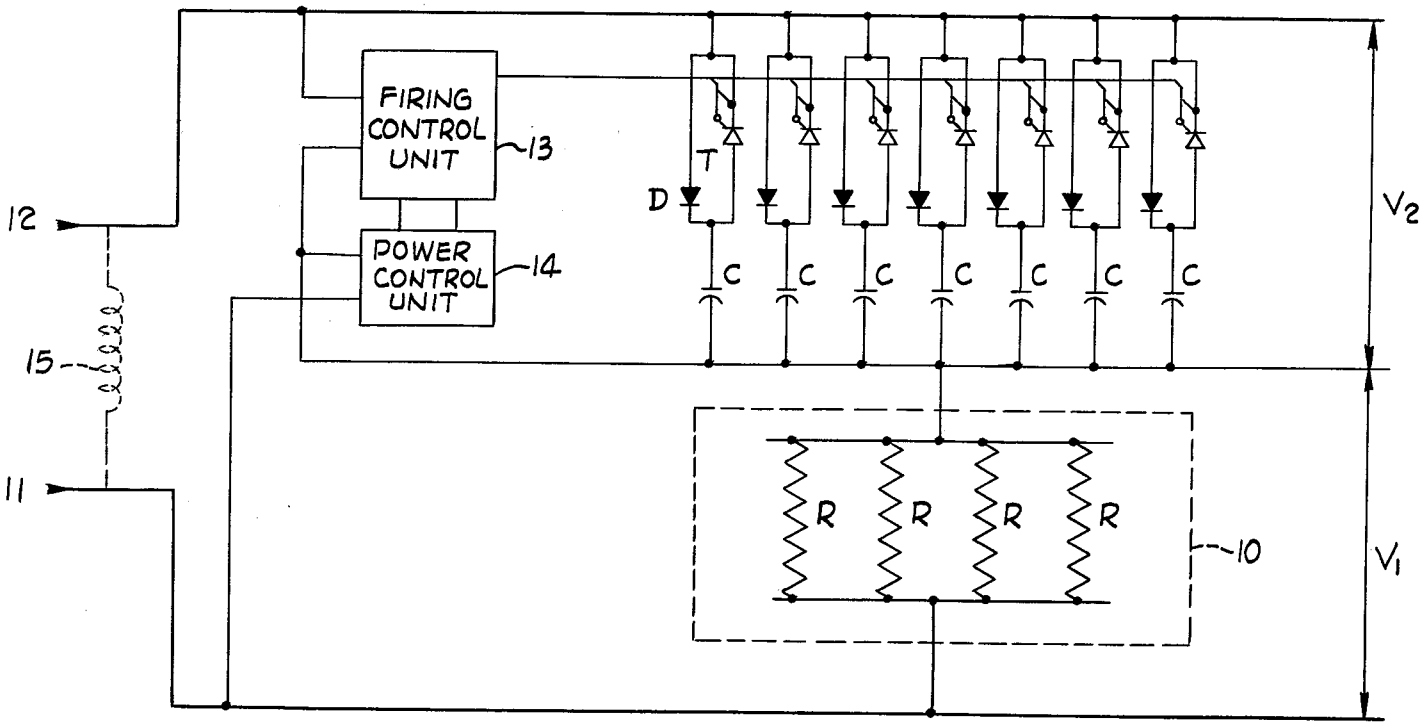
FIG. 1 shows the schematic diagram of a circuit of my invention including a firing control unit and a power control unit for controlling the power to be delivered to a single phase load.

Referring now to the drawings, in all of which like parts are designated by like reference characters, in FIG. 1 a form of the circuit of the system of my invention is illustrated. It consists of a load 10 which is shown as a resistive load, such as a resistor furnace, and which is connected to one side 11 of a single phase line frequency alternating current supply, and power control means for said load, comprising a group of sets of series connected capacitance and semiconductor means connected in parallel and interposed between the other side 12 of said power supply and the load. The semiconductor means within each set consist of diode rectifier means conducting current only in one direction and controlled rectifier means in parallel therewith conducting current only in an opposite direction. Also shown in FIG. 1 is a firing control unit 13 which provides control signals to initiate the conduction of the controlled rectifier means T, and a power control unit 14. THe function of the power control unit 14 is to adjust precisely and automatically the value of the capacitance effectively connected in the circuit in series between the supply line 12 and load 10 so as to maintain or regulate the power delivered to said load. The actual connection of the proper amount of capacitance into the circuit is achieved by selectively rendering conductive the appropriate controlled rectifier means T.

Reactance 15 can be connected across the single phase alternating current lines 11 and 12 so a reduction of the leading current drawn from the lines under controlled mode of operation can be effected if desired.

Considerable information is available in the literature where anti-parallel connected silicon controlled rectifiers are utilized for the control of power to single phase loads of various configurations. A great disadvantage of this type of control is the inherent harmonic or subharmonic pollution it causes in the supply lines if unfiltered.

A harmonic-free power control means for induction furnaces comprising combinations of sets of controllable semiconductor means connected in series with capacitance has been disclosed in my U.S. Pat. No. 3,821,456. In utilizing the power control means of such previous invention in applications where large amounts of electrical power must be controlled, the initial starting transients disclosed in said patent can cause high frequency oscillations necessitating the use of additional protective circuitry or derating of the semiconductor means within a set.

The present invention, utilizing sets comprising diode rectifier means connected to conduct current only in one direction and controlled rectifier means connected in parallel therewith to conduct current only in an opposite direction and capacitance in series therewith, eliminates such transient currents.

Figure 2:
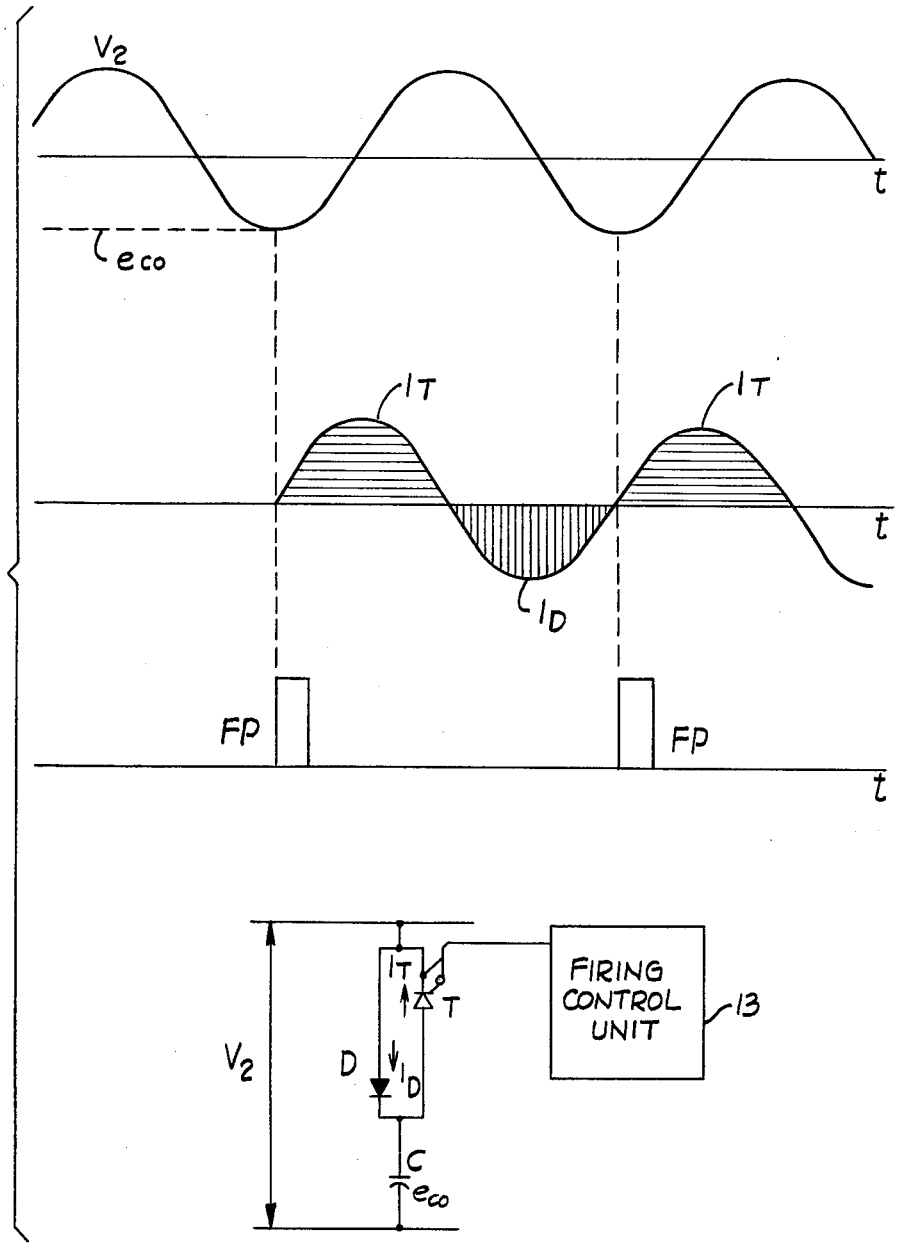
FIG. 2 shows the voltage $V_2$ across a set, the initial voltage $e_{co}$ across the capacitance within the set, firing pulse FP, the current through the diode rectifier means D and the current through the controlled rectifier means T at the time of initiation of conduction of the selected controlled rectifier means and subsequently the continued harmonic-free alternating current flow thereafter.

A complete understanding of the functioning of the new combination of elements within a set can be obtained by observing the time relationship of the voltage $V_2$ across a selected set, the initial voltage $e_{co}$ across the capacitance C, the current $I_D$ through the diode rectifier means D, the current $I_T$ through the controlled rectifier means T, and the firing pulses FP at the time current flow is initiated, and continuing thereafter, as shown in FIG. 2. Note that when the set is not in conduction the initial voltage $e_{co}$ across the capacitance C is maintained at the maximum value of $V_2$ by the diode rectifier means D. No alternating current can flow through the set, however, until the controlled rectifier means T is rendered conductive. Conduction is initiated by rendering the controlled rectifier means T conductive precisely at the instant when the voltage $V_2$ across the set attains its maximum value of like polarity as the initial voltage $e_{co}$ across capacitance C. The result is a completely transient and harmonic-free alternating current through the set from the time of initiation of conduction and thereafter.

It is extremely important to control the instant of gating of the controlled rectifier means precisely if transient-free and harmonic-free currents are to be maintained in the set.

In the case of one type of load shown herein, i.e., resistor furnaces as used for heating or melting, which may be of the metallic resistor type, silicon carbide resistor type or graphite resistor type, these constitute a substantially resistive load with only a slight inductive component, their resistance changes but very little during the normal work cycle, and their power factor will be typically between 85% and 95% and likewise will remain substantially unchanged over the work cycle. The phase angle between voltages $V_1$ and $V_2$ will remain substantially constant and the voltages will remain within a safe range and it thus becomes unnecessary to use means to control the phase angle as described and claimed in the co-pending application Ser. No. 601,644, filed Aug. 4, 1975.

Another type of load for which the control means of the present invention can be used would be the inductor of a channel induction melting furnace with its associated parallel capacitor. Such an inductor represents a single phase load. A typical inductor for melting zinc will have a power factor of about 35% and its impedance and power factor typically remain unchanged over a period of months. Connecting of fixed capacitors in parallel with said inductor will correct the load power factor to a value in the order of 80% which is suitable for the stepless control of power in accordance with the invention.

In practice, in the case of loads of a high power rating, to increase the current and/or voltage capability of the diode rectifier means and the controlled rectifier means within a set, series and/or parallel connection of individual diode rectifiers as well as controlled rectifiers are required. It is particularly important in most practical cases to connect several diode rectifiers in series and several controlled rectifiers in series within each set.

FIG. 3 illustrates a possible connection for my improved combination of new elements in a set: Two diode rectifiers D are connected in series to conduct current only in one direction and two series connected controlled rectifiers T are connected in parallel therewith to conduct current only in an opposite direction. In series with this parallel connected combination of series connected diode rectifiers and series connected controlled rectifiers is connected capacitance C, forming a set. The number and size of the diode rectifiers which are connected in series in a string must not necessarily be equal to the number and size of the controlled rectifiers connected in series in a string and connected in parallel with said diode rectifiers.

FIG. 4 illustrates another modification of the improved combination of my invention. Two diode rectifiers D are connected in series in a string, all connected to conduct current only in one direction. In parallel with and across each of said series connected diode rectifiers there is connected a controlled rectifier T, to conduct current only in an opposite direction. Said combination of diode rectifiers and controlled rectifiers is connected in series with capacitance C, to form a set. The number and size of the series connected diode rectifiers and controlled rectifiers used within a set is dependent on circuit considerations.

FIG. 5 shows another possible combination of my invention where capacitance C is connected between two diode rectifiers D. Each of said diode rectifiers is connected to conduct current in only one direction. Parallel with each said diode rectifier is connected a controlled rectifier to conduct current only in an opposite direction, to form a set.

Note that all the diode rectifiers within a set in each of the above discussed figures are connected to conduct current only in one direction and all the controlled rectifiers within a set are connected to conduct current only in an opposite direction. The fact that all the diode rectifiers within a set are connected to conduct current only in one direction ensures that the initial voltage $e_{co}$ present at the initiation of the conduction of the selected controlled rectifiers is substantially of the same magnitude as the maximum value of the AC voltage $V_2$ appearing across the set. Hence, if in the circuit of either FIG. 4 or FIG. 5 one would reverse the direction in which the upper diode rectifiers and controlled rectifiers would conduct within a set, the transient-free operation taught in my present invention would not be realizable, because the initial voltage across the capacitance could not be held at the maximum value of the AC voltage appearing across the set at the time of initiation of conduction of the set. The operation of such connection would result in transients such as the ones occurring at the initiation of conduction of a set as shown in FIG. 3 of my previous U.S. Pat. No. 3,821,456.

It is to be understood that whenever a "set" within the meaning of this invention is referred to, it shall comprise diode rectifier means connected to conduct current only in one direction and controlled rectifier means connected in parallel therewith to conduct current only in an opposite direction, and capacitance connected in series therewith. This novel combination of elements forming each set, as disclosed and claimed herein, enables the system to operate in a completely transient-free manner as amply demonstrated by the wave shapes shown in FIG. 2 and with better utilization of the semiconductor means within said set or sets.

What I claim is:

1. Power control means for a single-phase load whose impedance changes slightly over a work cycle for operation from a normal line frequency power supply, one line of said power supply being connected to the first terminal of said load, said power control comprising a group of sets of series connected capacitance and semiconductor means connected in parallel and interposed between another line of said power supply and the second terminal of said load, each said semiconductor means within each said set comprising diode rectifier means connected to conduct current only in one direction and controlled rectifier means connected in parallel therewith to conduct current only in an opposite direction, said controlled rectifier means being actuated by firing control means adapted to control the transition of each such controlled rectifier means form the non-conducting to the conducting state, the conduction of said controlled rectifier means within each selected set when required being initiated substantially at the instant when the voltage across said set attains its maximum value of like polarity as that of the voltage across the capacitance of said set prior to initiation of conduction and wherein conduction of said set is maintained continuously thereafter to produce a transient-free and harmonic-free alternating current in said set until deenergized, the number and size of sets conducting within said group determining the total amount of capacitance effectively interposed between said other power supply line and said second load terminal, thereby controlling the voltage and power delivered to said load.

2. Power control means as claimed in claim 1 wherein an inductive reactance is connected across the input terminals to provide an improved line power factor.

3. Power control means as claimed in claim 1 wherein the single phase load is a resistor furnace, the phase angle between the load voltage and series capacitor voltage remaining substantially constant during the work cycle.

4. Power control means as claimed in claim 1 wherein the single phase load is the inductor of a channel induction melting furnace having fixed capacitance connected in parallel with said inductor.

* * * * *